United States Patent [19]

Rinkewich

[11] Patent Number: 4,632,313

[45] Date of Patent: Dec. 30, 1986

[54] MULTIPLE CHAMBER SPRINKLER

[76] Inventor: Isaac Rinkewich, 12 Fishman Maimon Street, Tel-Aviv, Israel

[21] Appl. No.: 544,360

[22] Filed: Oct. 21, 1983

[30] Foreign Application Priority Data

May 5, 1983 [IL] Israel ..... 68597

[51] Int. Cl.[4] ..... B05B 3/16

[52] U.S. Cl. ..... 239/242; 239/447; 239/98; 137/624.14

[58] Field of Search ..... 239/97–100, 239/242, 240, 444, 447, 245, 243; 137/624.17, 624.13, 624.14

[56] References Cited

U.S. PATENT DOCUMENTS

| | | | |
|---|---|---|---|
| 1,558,355 | 10/1925 | Hart | 239/97 |
| 1,983,929 | 12/1934 | Buelma et al. | 239/240 X |
| 2,081,510 | 5/1937 | Smart | 239/99 X |
| 2,670,993 | 3/1954 | Nordenstam | 137/624.14 X |
| 2,693,390 | 11/1954 | Spender et al. | 239/240 X |
| 3,026,044 | 3/1962 | Kennedy | 239/97 |
| 3,084,714 | 4/1963 | Getz et al. | 137/624.13 X |
| 3,282,509 | 11/1966 | Starr | 239/242 |
| 3,332,624 | 7/1967 | Rinkewich | 239/242 |
| 3,362,641 | 1/1968 | Barnes | 239/97 |
| 3,464,628 | 9/1969 | Chow | 239/97 |
| 4,077,424 | 3/1978 | Ehret et al. | 137/624.14 X |
| 4,313,455 | 2/1982 | Pitman | 137/624.14 X |

FOREIGN PATENT DOCUMENTS

| | | | |
|---|---|---|---|
| 503750 | 2/1922 | France | 137/624.13 |

*Primary Examiner*—Joseph F. Peters, Jr.
*Assistant Examiner*—Kevin Patrick Weldon
*Attorney, Agent, or Firm*—Benjamin J. Barish

[57] ABSTRACT

A sprinkler comprising a plurality of horizontally extending chambers each including a plurality of spray nozzles oriented at different angles, a drive for cyclically driving the sprinkler about its horizontal axis, and water-steering means for selectively steering the water to the plurality of chambers while the sprinkler is cyclically driven about its horizontal axis. In one described embodiment, the plurality of chambers are oscillated about the horizontal axis of the sprinkler; and in other described embodiments, the plurality of chambers are rotated about the horizontal axis of the sprinkler.

9 Claims, 13 Drawing Figures

110
112
VII
VII
128
126
106
140
132
136
118
114
110b
110c
112
110a
110d

MULTIPLE CHAMBER SPRINKLER

BACKGROUND OF THE INVENTION

The present invention relates to sprinklers. It relates particularly to the oscillator type sprinkler which includes a water distributor tube carrying a plurality of spray nozzles along its length oriented at different angles in order to distribute the water over a wide area. While the invention is particularly useful in the above-described oscillator-type sprinkler, it can also advantageously be used in a rotary-type sprinkler, as will be apparent from the description below.

One of the advantages of oscillating sprinklers is that they produce a rectangular wetting pattern, as distinguished from the conventional rotatable sprinklers which produce a circular wetting pattern. However, because of the large number of spray nozzles fed by the oscillating water distributor tube, such oscillating sprinklers require a relatively high pressure in the water supply line in order to wet a given size area. Thus, if the water pressure of the supply line is not sufficiently high, the range of the sprinkler may be substantially restricted. In addition, because of the large number of nozzles fed from the oscillating water distributor, the nozzles must be of relatively small diameter, thereby producing small-diameter spray jets having not only a relatively short range, but also relatively high wind and evaportation losses. Moreover, at high pressure the jet streams become mist, which thereby shortens the spray range and reduces substantially the sprinkler coverage.

An object of the present invention is to provide a sprinkler having advantages in the above respects.

BRIEF SUMMARY OF THE INVENTION

According to a broad aspect of the present invention, there is provided sprinkler comprising a housing including an inlet connectible to a source of pressurized water; a plurality of horizontally-extended chambers each including at least one spray nozzle, the spray nozzles of all the chambers being oriented at different angles with respect to the horizontal axis of the sprinkler; a drive for cyclically driving the sprinkler about its horizontal axis; and water-steering means for selectively steering the water to the plurality of chambers while the sprinkler is cyclically driven about its horizontal axis. The water is steered to each chamber for a different period of each cycle such that the nozzles of each chamber produce different spray patterns determined by their respective angle, all the spray patterns combining to wet the area to be covered by the sprinkler.

The invention is particularly useful for the above-described oscillator-type sprinkler, wherein the drive is an oscillating drive, and the plurality of chambers are oscillated thereby about the horizontal axis of the sprinklers. An embodiment of the invention is described below wherein the sprinkler includes two chambers in the form of two parallel, water distributor tubes each including a plurality of spray nozzles spaced along its length.

Oscillating sprinklers constructed in accordance with the foregoing features provide a number of important advantages. Thus, this construction enables each water distributor tube to include only one-half the number of nozzles as in a conventional construction, thereby enabling each nozzle to have a substantially larger diameter. This permits the sprinkler to be used with relatively low water pressure in the supply line, and also increases the wetting area for a given water pressure. Moreover, since the sprinkler enables larger diameter nozzles to be used, the water jet issuing from each nozzle is also of larger diameter, thereby substantially decreasing water losses because of wind or evaporation, and also decreasing the formation of a mist at high pressure.

The invention, however, may also be embodied in a rotary-type sprinkler, wherein the drive is a rotary drive, and the plurality of chambers are rotated thereby about the horizontal axis of the sprinkler. Two such embodiments of the invention are described below, wherein the plurality of chambers are defined by a water distributor tube whose interior is divided into said plurality of chambers.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Embodiment of FIGS. 1–4

The sprinkler illustrated in FIGS. 1–4 of the drawings is of the 10-nozzle oscillating type, i.e. for use in applications requiring ten nozzles of different angular orientations in order to wet the required area. In the conventional 10-nozzle oscillating sprinkler, all 10 nozzles are spaced along the length of a single water distributor tube, which tube is oscillated about its own longitudinal axis, or about an axis otherwise parallel to it, in order to distribute the water according to a rectangular wetting pattern. The sprinkler illustrated in FIG. 1, however, also includes 10 nozzles having different angular orientations, but here the nozzles are provided on two water distributor tubes, each tube including one-half, or five, of the nozzles.

Figure 1:
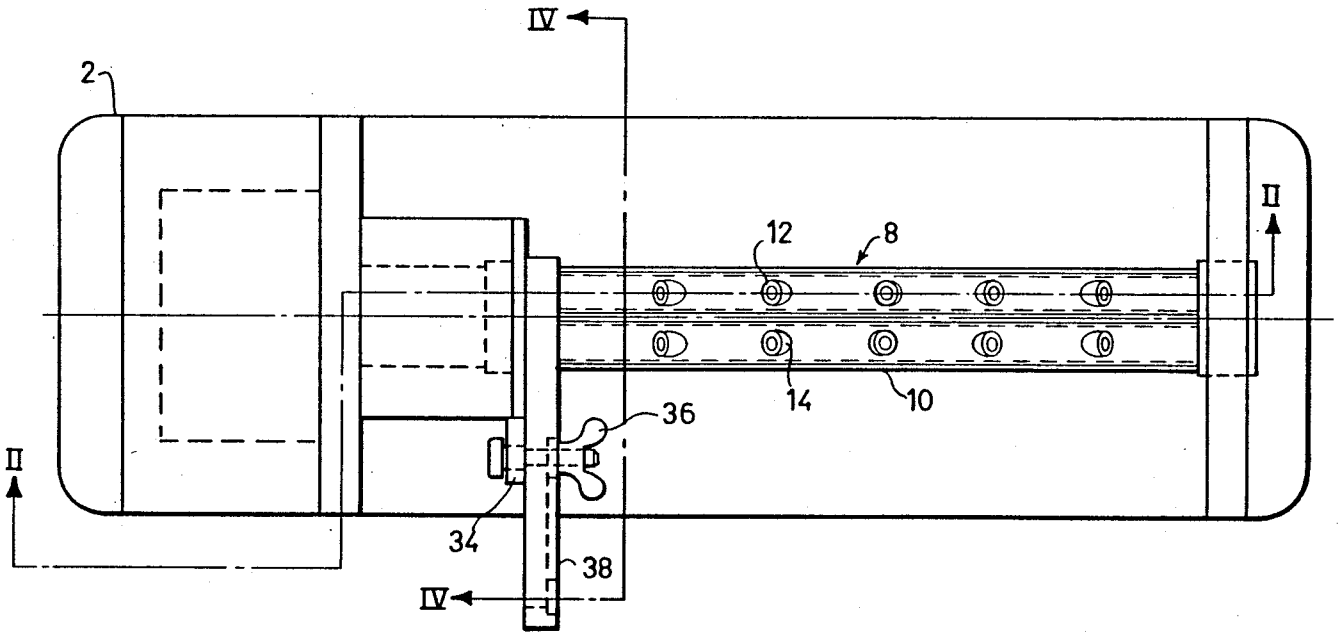
FIG. 1 is a top plan view illustrating one form of oscillating sprinkler constructed in accordance with the present invention.
Figure 2:
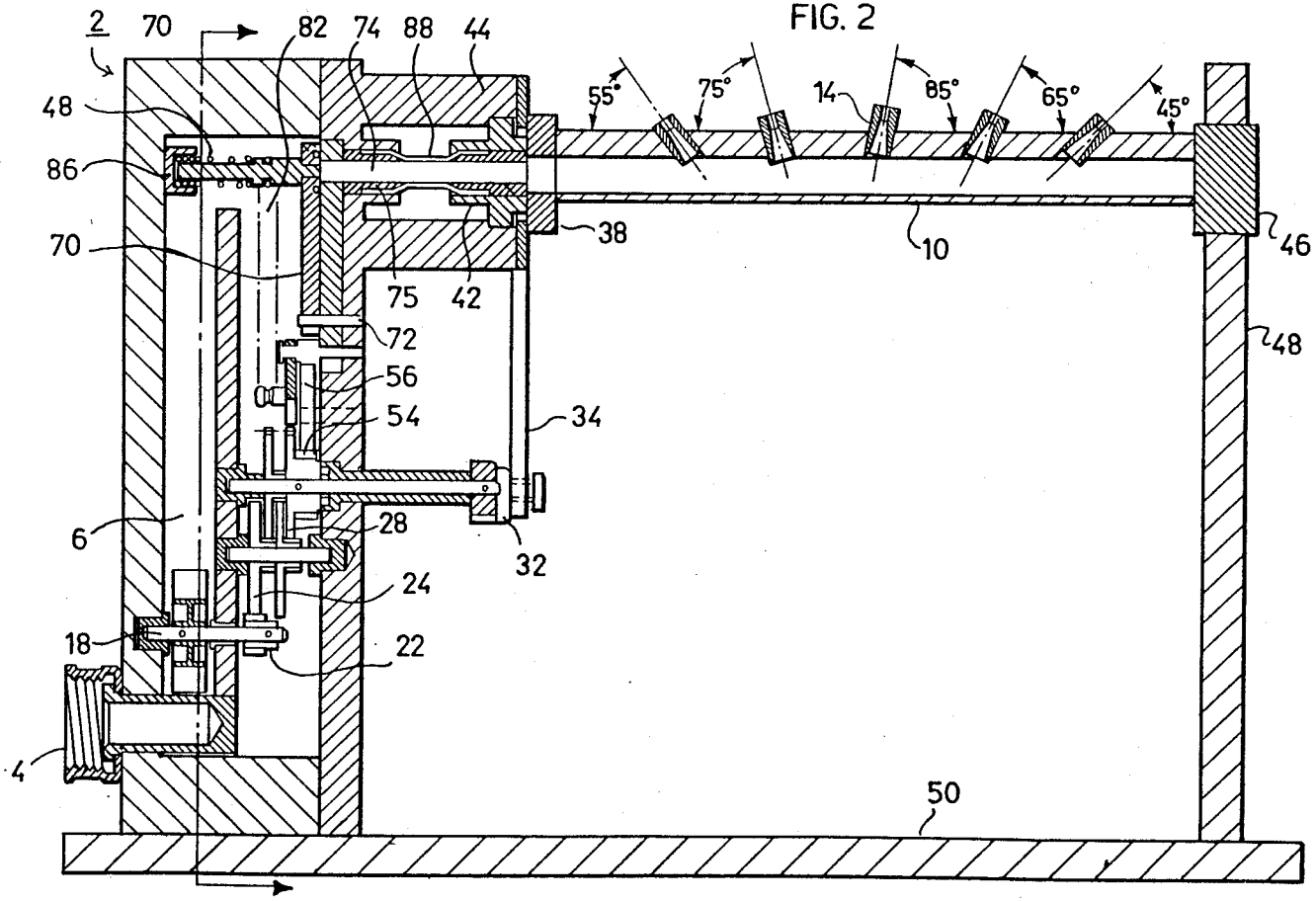
FIG. 2 is longitudinal section view being along lines II—II of FIG. 3.
Figure 3:
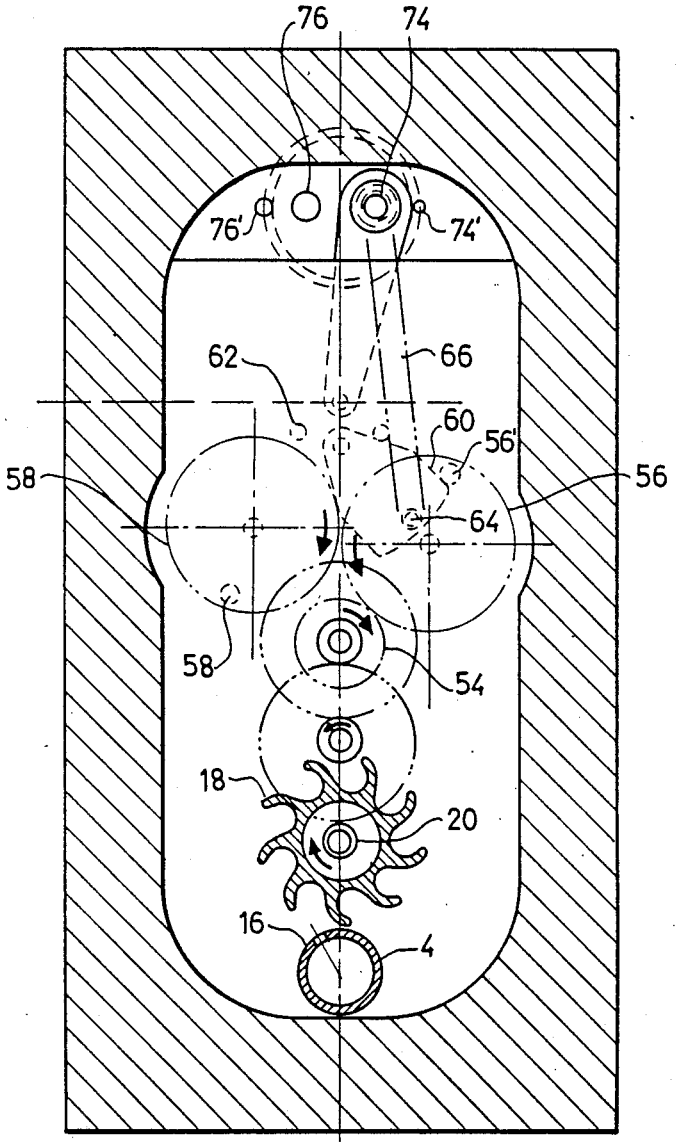
FIG. 3 is a transverse sectional view along lines III—III of FIG. 2.

Thus, as shown particularly in FIGS. 1 and 2, the oscillating sprinkler comprises a housing 2 including an inlet coupling 4 connectible to a source of pressurized water, which water is fed via an internal chamber 6 within housing 2 to two water chambers, in the form of a pair of water distributor tubes 8 and 10, each provided with a plurality of nozzles 12 and 14, respectively, spaced along the length of the distributor tube. Both of the water distributor tubes 8, 10 are oscillated together by a drive disposed within chamber 6 of the sprinkler housing 2, which drive utilizes the kinetic energy of the water flowing through the chamber. In addition, chamber 6 of the sprinkler housing 2 further includes water steering means for selectively steering the water to the two water distributor tubes 8, 10 during alternate cycles of the sprinkler. The two groups of nozzles 12, 14 are oriented at different angular positions with respect to the longitudinal axis of the respective water distributor tube 8, 10 so that each two oscillating cycles of the sprinkler produce a fairly uniform distribution of the water over the rectangular are wetted by the sprinkler.

More particularly, the water from inlet coupling 4 is fed into an inlet chamber 6 via opening 16 (FIG. 3) and impinges on the blades of an impeller 18 to rotate the impeller and its shaft 20 rotatably supported between one wall of housing 6 and an inner wall 21. The opposite end of the impeller shaft carries a pinion 22 meshing with a gear 24 of a gear assembly 26, the latter including another gear 28 rotating a crank shaft 30. As shown particularly in FIGS. 2 and 4, crank shaft 30 rotates a crank arm 32 to reciprocate a curved connecting link 34 up and down in the vertical direction. The opposite end of connecting link 34 is coupled by a wing nut 36 to a further link 38 which is pivotably mounted about a pivot axis 40. The two water distributor tubes 8, 10 are secured to pivotable link 38 so as to oscillate with that link about pivot axis 40 extending longitudinally. The inner ends of the water distributor tubes 8, 10 secured to link 38, are also secured to a bearing 42 (FIG. 2) supported for rotatable movement within a socket formed in extension 44 of the sprinkler housing 42. The outer ends of the distributor tubes 8, 10 carry a second bearing 46 which closes the ends of the tubes and rotatably supports them within a circular socket formed in a vertical plate 48 secured to base 50 of the sprinkler housing.

Figure 4:
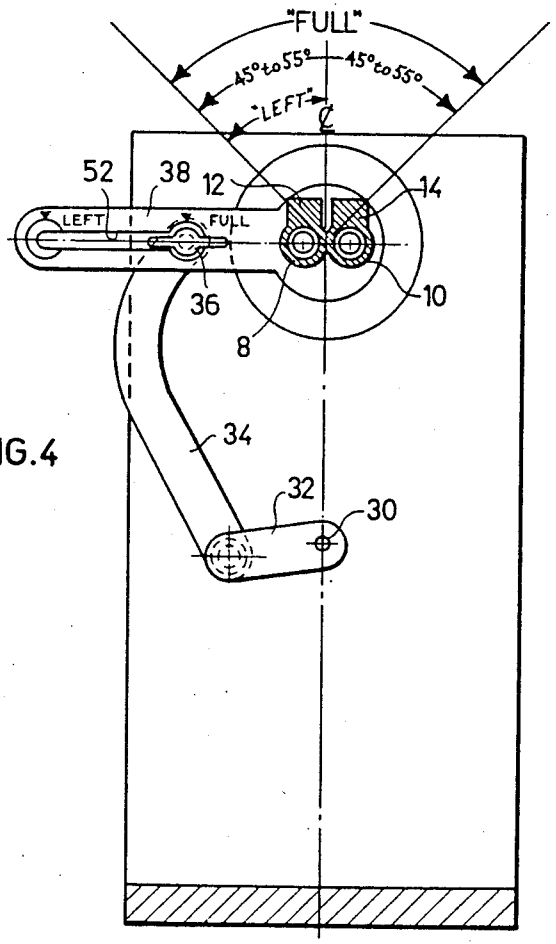
FIG. 4 is a transverse sectional view along lines IV—IV of FIG. 1.

It will thus be seen that the rotation of crank 32 by the impeller 18 will reciprocate link 34 in the vertical direction, and will thereby oscillate link 38 and both of the water distributor tubes 8, 10 about pivot axis 40. Link 38 is provided with a slot 52 to permit the amplitude of oscillation of the distributor tubes to be varied, this being conveniently done by the use of wing nut 36 to secure the end of link 34 at the desired location within slot 52. Thus, if link 34 is secured in the "FULL" position of slot 52 (as illustrated in FIG. 4), the coupling point is close to the pivot axis 40, and therefore the water distributor tubes 8, 10 will be oscillated for a relatively large amplitude, in this case from about 90° to 110°; but if the coupling point of link 34 to link 38 is moved to the other end ("LEFT" position illustrated in FIG. 4) of slot 52, the amplitude of oscillations will be reduced to an amplitude of about 45° to 55° on only one side of the vertical plane.

The water steering means for steering the water to one water distributor tube 8, 10 during one oscillating cycle, and to the other during the next oscillating cycle, is also driven by impeller 18 via gear assembly 26. For this purpose, gear assembly 26 includes another pinion 54 meshing with another gear 56, which latter gear meshes with a further gear 58, the arrangement being such that both gears 56 and 58 are rotated in opposite directions at the same angular velocity with respect to each other, but at one-half the angular velocity of pinion 54. Each of the gears 56, 58 includes a pin 56', 58', respectively, cooperable with one end of a cam plate 60, whose opposite end is pivotably mounted at 62 substantially midway between the rotary axes of the two gears 56, 58.

Cam member 60 includes a pin 64 at its end opposite to that of its pivot axis 62, which pin 64 is connected by a coil spring 66 to another pin 68 carried at one end of a valve member 70, the opposite end of the valve member being pivotably mounted at 72. Valve member 70 is pivotable to a first position, as illustrated in full lines in FIG. 3, to cover port 74 leading to water distributor tube 10, or to a second position to cover port 76 leading to water distributor tube 8, both positions of the valve member 70 being defined by pins 74', 76', respectively, engageable with the side of the valve member.

It will thus be seen that during a complete rotation of pinion 54, during which the water distributor tubes 8, 10 are oscillated through a complete osicllation cycle (constituted of two strokes), both gears 56 and 58 will be rotated one-half of a revolution. Thus, during each complete oscillating cycle, valve member 70 is moved with a snap-action, because of the over-center connection of spring 66 between valve member 70 and cam plate 60, to uncover one of the ports 74, 76, leading to the two water distribution tubes. 8, 10; and during the next oscillation cycle, the valve member 70 is moved, again with a snap-action, to uncover the previously-covered port and to cover the previously-uncovered port. Thus, one of the two water distribution tubes 8, 10 will be supplied with pressurized water during one complete oscillation cycle of the sprinkler, and the other will be supplied during the next oscillation cycle.

As shown particularly in FIG. 2, pivotable valve member 70 is formed with an axial stem 82 receiving a spring 84 between it and a low-friction slide button 86 engageable with the inner face of the housing chamber 6 so as to assure a good seal between the valve member and the two ports 74,76 leading to the two water distributor tubes 8, 10. Each of the latter ports is provided with a nipple, as shown at 75 in FIG. 2 with respect to port 74, receiving one end of a flexible hose 88, the other end of hose 88 being received on a nipple for the rotary bearing 42 of the respective water distributor. Hoses 88 are flexible to permit the oscillations of their water distributor tubes 8 and 10.

As mentioned earlier, the angular orientations of the two groups of nozzles 12, 14 are different from each other so as to provide a uniform distribution of the water over the area to be wetted by the sprinkler. Preferably, the angles of nozzles 14 on water distributor tube 10 are staggered with respect to nozzles 14 are angularly oriented at 20° apart from each other, namely (starting from the inner end) at 55°, 75°, 95°, 115°, and 135° respectively. Nozzles 12 carried on water distributor tube 8 may therefore be oriented (starting from the left) at 45°, 65°, 85°, 105°and 125°, respectively.

The operation of the osicllating sprinkler illustrated in the drawings will be apparent from the above description, Thus, when pressurized water is inletted via inlet 4, it drives impeller 18, which, via the gear assembly 26, rotates crank arm 32 and thereby oscillates via links 34 and 38, the two water distributor tubes 8 and 10, the amplitude of oscillation being presettable by using wing knot 36 to prefix the upper end of link 34 at the appropriate position within slot 62 of link 38.

During one complete oscillation cycle of the water distributor tubes 8, 10, valve member 70 will uncover the inlet port 74, 76 of one tube, and cover that of the other tube, so that the water will be supplied only to one of the distributor tubes; and during the next oscillation cycle, valve member 70 will be moved to the opposite position to reverse the connections to the water distributor tubes. Thus, both gears 56 and 58, being driven at twice the angular velocity as crank shaft 32, will, by the engagement of their pins 56', 58' with cam plate 60, shift the cam plate in one direction during one complete cycle of crank shaft 32, and in the opposite direction during the next complete cycle. This shifting of the cam plate, being coupled to valve member 70 by the over-center spring 66, will move the valve member with a snap-action at the end of each oscillating cycle to cover and uncover the inlet ports 74, 76 of the water distributor tubes 8, 10 so that one tube is fed with the pressurized water during one oscillation cycle, the other tube is fed with the pressurized water during the next cycle.

It will be appreciated that by providing two water distributor tubes, each feeding a group of nozzles at different periods, the nozzles may have significantly larger diameters than in the conventional sprinkler wherein all the nozzles are fed at the same time. As indicated earlier, this permits the sprinkler to wet a given area under low water pressure, and to wet a larger area for the normal water pressure conditions as compared to conventional sprinklers of this type. Further, since the jets issuing from the sprinkler nozzles are of larger diameter, there is less tendency to produce a mist at high pressure, and less loss due to wind or evaporation.

It will be appreciated that other arrangements could be used for oscillating the sprinkler, and for steering the water from one distributor tube to the other during the oscillations of the sprinkler. For example, the water steering could be effected by rotating valves, a floating valve plate, or a Geneva mechanism; and the connection to the water distributor tubes could be effected by a floating gland, rather than by the flexible hoses. Further, the oscillating sprinkler may include more than two water distributor tubes each having a group of nozzles and each selectively supplied with water during a portion of a complete oscillating cycle. For example, there could be four of such water distributor tubes, each one being supplied with water during every fourth cycle, thereby enabling the sprinkler to be used under even lower water pressure conditions and/or to provide even greater range, Theoretically, there could be as many water distributor tubes as nozzles, with each nozzle at a different angular position, the number of the nozzles being determined by the number of angular position needed in order to distribute the water over the area to be wetted.

Still further, the two (or more) water chambers defined by the water distributor tubes could be in the form of a single water distributor tube whose interior is partitioned to provide the two (or more) chambers. Moreover, the plurality of chambers could be rotated rather than oscillated. Three further embodiments of the invention constructed in accordance with these features are illustrated in FIGS. 5–7, 8–10 and 11–13, respectively.

Figure 5:
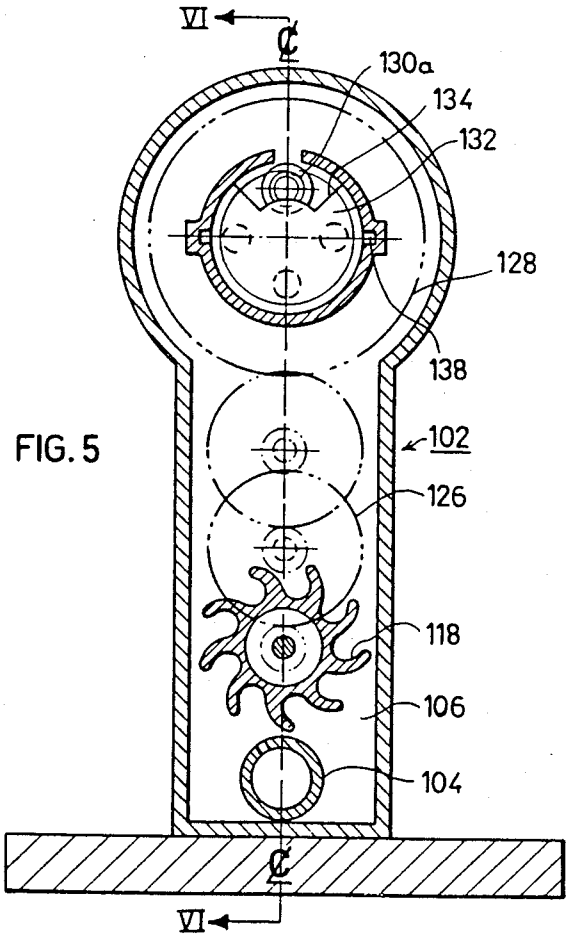
FIGS. 5–7 illustrate one form of rotary-type sprinkler constructed in accordance with the invention, FIG. 5 being a sectional view along lines V—V of FIG. 6, FIG. 6 being a sectional view along lines VI—VI of FIG. 5, and FIG. 7 being a sectional view along lines VII—VII of FIG. 6.
Figures 6, 7:
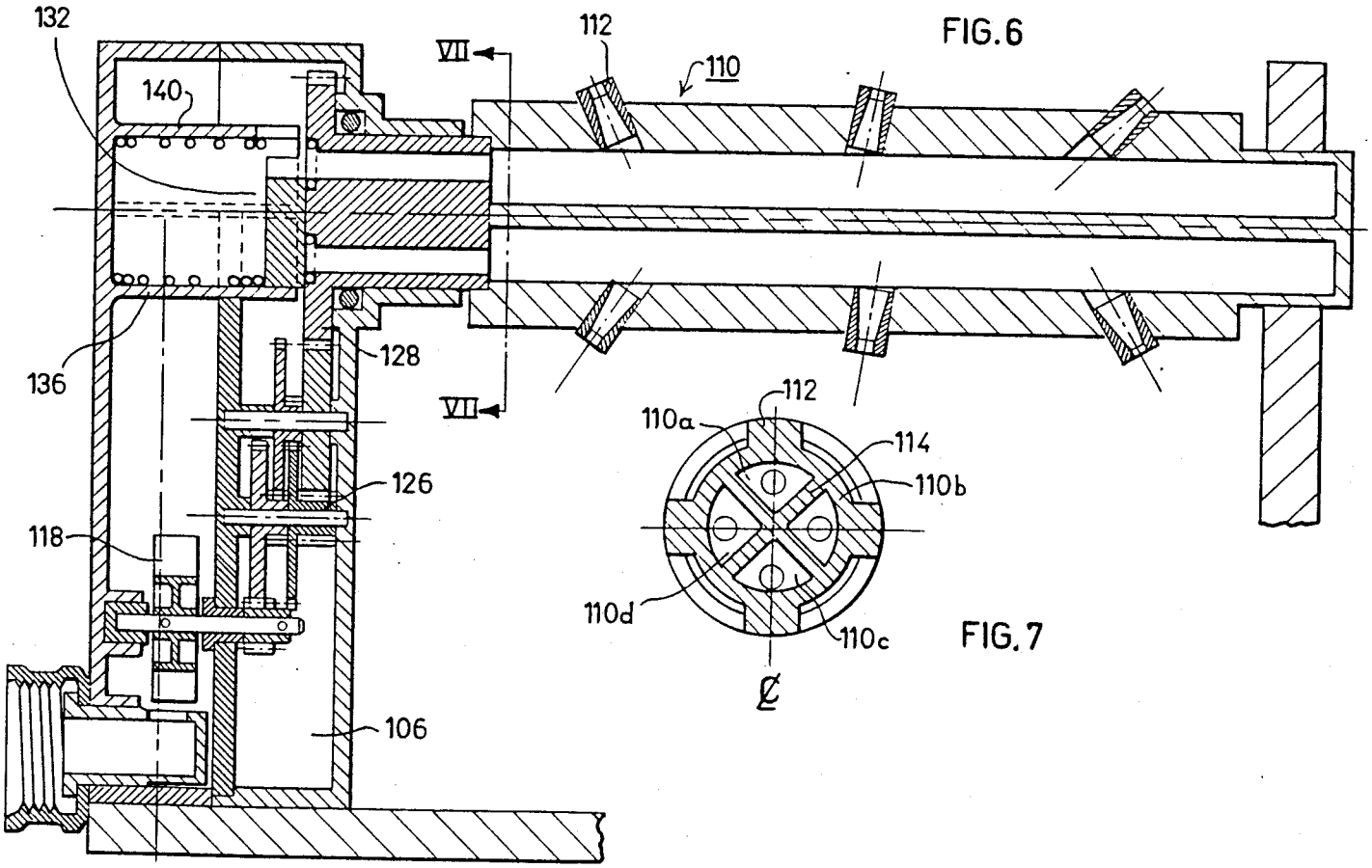

Embodiment of FIGS. 5–7

The rotary sprinkler illustrated in FIGS. 5–7 includes a housing 102 having an inlet coupling 104 connectible to the supply line for inletting the water into the inlet chamber 106 through which the water passes to a water distributor pipe 110 having a plurality of nozzles 112. The water distributor pipe 110 is internally divided by partition walls 114 to define a plurality, in this case four, chambers **110*a*–110*d* each communicating with one group of nozzles 112. As described in FIGS. 1–4 embodiment, all the nozzles are differenly oriented with respect ot the horizontal axis of the sprinkler so that they together uniformly cover the area to be wetted. In this case, however, since there are four chambers each supplying one group of nozzles, rather than two chambers in the FIGS. 1–4 embodiment, the number of nozzles for each chamber in the FIGS. 5–7 embodiment may be but one-fourth of the total number required, rather than one-half in the FIGS. 1–4** embodiment.

The water passing through the inlet chamber 106 impinges an impe11er 118 which, via gears 126, drives gear 128 mechanically coupled to the multiple-chamber distributor tube 110, such that the distributor tube is continuously rotated (rather than oscillated in the FIGS. 1–4 embodiment) by the kinetic energy of the water. Gear 128, to which the multiple-chamber water distributor tube 110 is secured, is formed with a plurality of inlet openings **130*a*–130*d*, one for each of its chambers 110*a*–110*d*. These openings are covered by a floating valve plate 132 having an arcuate cut-out defining a window 134 adapted to be aligned with the inlet openings 130*a*–130*d* during the rotation of the multiple-chamber distributor tube 110**.

Valve plate 132 is received within a cylindrical housing 136 formed in inlet chamber 106, and is provided with ribs 138 received within grooves formed in the inner face of housing 136 to prevent the rotation of the valve plates during the rotation of the distributor tube 110. A spring 140 biasses valve plate 132 into engagement with the end face of gear 128 formed with the inlet openings **130*a*–130*d***.

It will thus be seen that the water flowing through the inlet coupling 102 to the water distributor tube 110 will impinge impeller 118 to rotate the water distributor tube, and to bring the inlet openings **130*a*–130*d* to the plurality of chambers 110*a*–110*d* successively into alignment with the window 134 of valve plate 132, the latter valve plate being keyed against rotation by its ribs 138. Window 134 of valve plate 132 is of sufficient arcuate length so as to overlie one of the inlet openings 130*a*–130*d* before the inlet opening of the preceding chamber moves out of alignment with the window, which thereby assures an uninterrupted flow of water through the sprinkler. Thus, during each cycle of rotation of the multiple-chamber water distributor tube 110, the group of nozzles 112 for each of the four water chambers 110*a*–110*d* will be supplied with water during the quarter cycle its nozzles are at the uppermost part of the distributor tube 110**. In this embodiment, therefore, the sprinkler effects a uniform distribution of the water over the area to be covered during each rotating cycle of the sprinkler.

Figure 8:
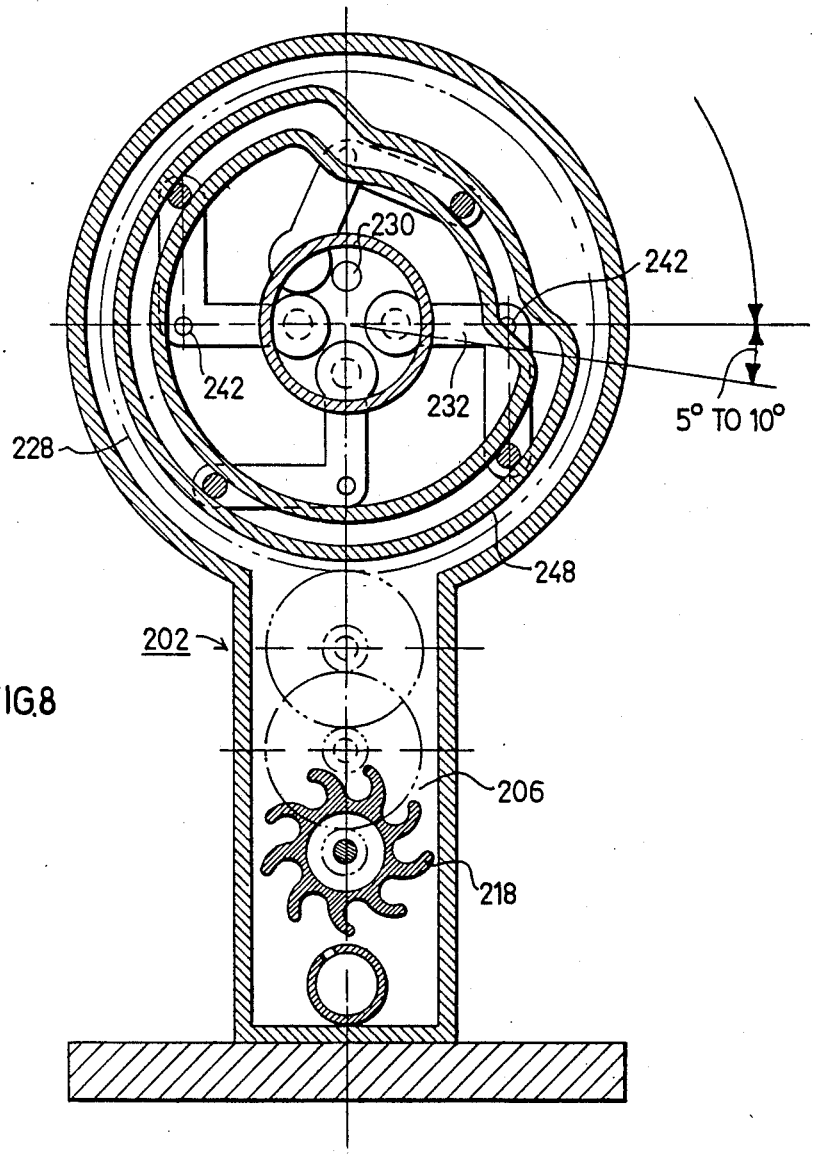
FIGS. 8–10 and 11–13 illustrate, respectively, two further forms of rotary-type sprinklers constructed in accordance with the invention.
Figures 9, 10:
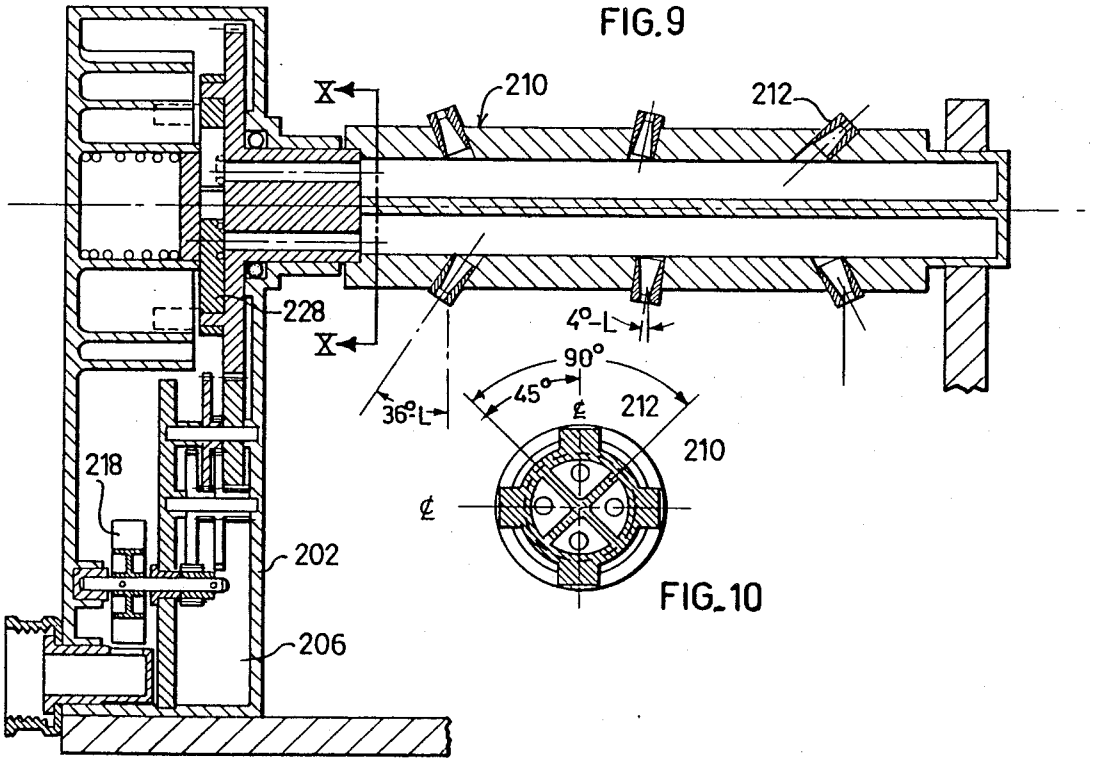

Embodiment of FIGS. 8–10

The embodiment of the invention illustrated in FIGS. 8–10 is similar to that of FIGS. 5–7, except that a different arrangement is used for steering the water from the inlet chamber, therein designated 206, to the inlet openings of the four chambers in the water distributor tube, therein designated 210. Thus, the embodiment illustrated in FIGS. 8–10 includes a plurality of valve members 232 which are movable during the rotation of the multiple-chamber distributor tube 210 to cover and uncover the inlet openings 230 to these chambers, and thereby to establish or interrupt communication between the inlet chamber 206 and the plural chambers of the water distributor tube 210. Each of the valve members 232 is pivotably mounted at 242 to the gear 228 fixed to the water distributor 210 and rotated by the impeller 218, so that these valve members also rotate with the distributor tube. Each valve member, however, includes a cam follower 244 movable within a cam-way 246 of a cam 248 fixed within the sprinkler housing 202.

The arrangement between the fixed cam-way 246, and the rotating cam followers 244 of the valve member 232, is such that each valve member is moved to its open position with respect to the inlet 230 to its respective chamber of the water distributor tube 210 for the quarter of the rotary cycle of the distributor tube when its nozzles 212 are at the upper position. In this case, also, the timing arrangement is such that the inlet opening to one chamber is not covered before the inlet opening to the next succeeding chamber is uncovered, so that there will be no interruption in the flow of the water through the sprinkler.

Figure 12:
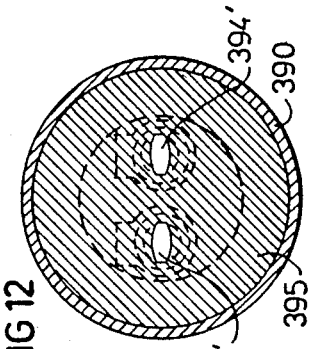
Figure 13:
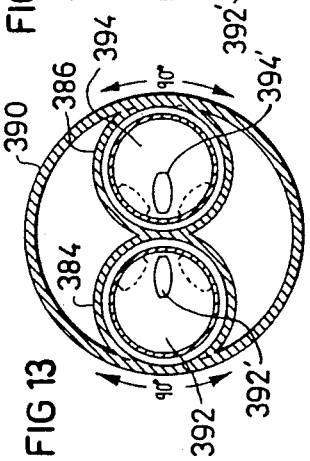
Figure 11:
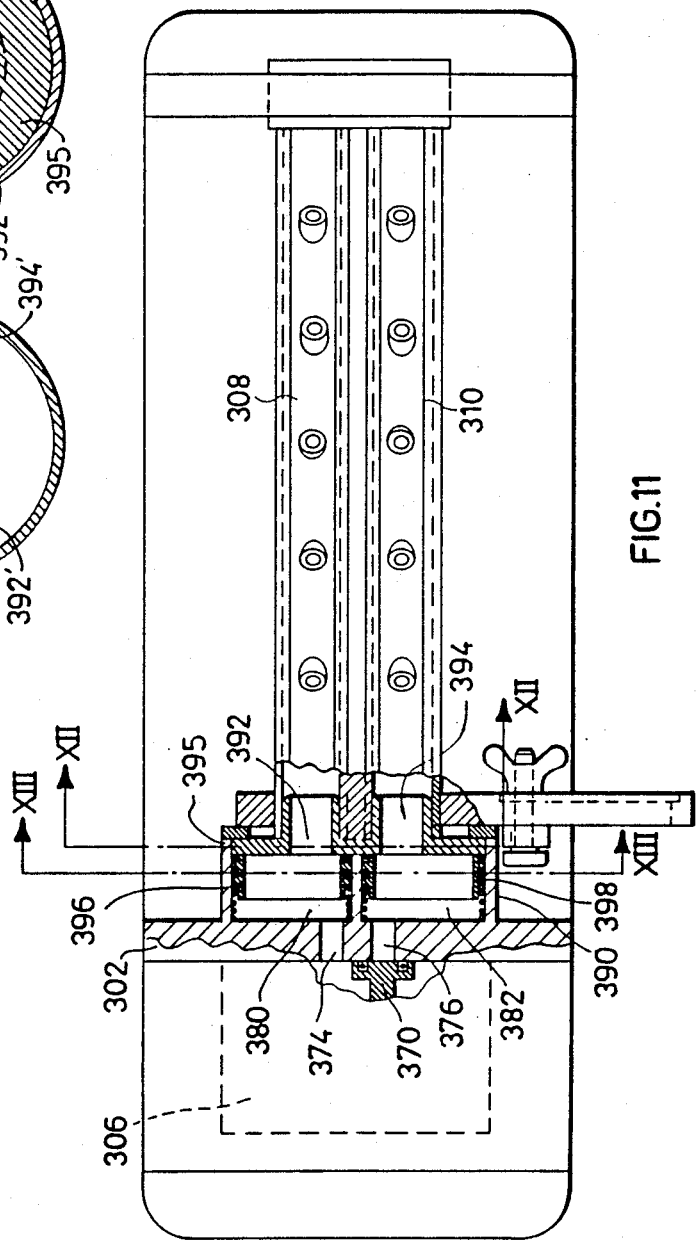

Embodiment of FIGS. 11–13

The embodiment of the invention illustrated in FIGS. 11–13 is similar to that of FIGS. 1–4, except that a different arrangement is used for steering the water from the inlet chamber, therein designated 306, to the two oscillating water distributor tubes 308 and 310. Thus, the pivotable valve member 370 selectively steers the water from the inlet chamber 306 through port 374 into compartment 380, or through port 376 into compartment 382. Compartments 380 and 382 are defined by two tubular extensions 384, 386, formed within an enlarged cylindrical extension 390 at the upper end of the housing 302.

The two water distributor tubes 308, 310 are pivotably mounted on end caps 392, 394, respectively, carried by an end wall 395 which oscillates with these tubes. End caps 392, 394, are aligned with the tubular extensions 384, 386 and include openings 392', 394' located (see FIG. 13) so as always to be within these tubular extensions and thereby in communication with compartments 380, 382 during all the oscillating positions of distributor tubes 308, 310. End wall 395 is sealed with respect to the tubular extensions 384, 386 by spring-biased seal-carrying sleeves 396, 398.

It will thus be seen that water distributor tube 308 is in continuous communication with compartment 380, that water distributor tube 310 is in continuous communication with compartment 382, and that the oscillating valve 370 steers the pressurized water first into one compartment and then into the other so that the water is sequentially steered to the two water distributor tubes 308 and 310.

Many other variations, modifications and applications of the invention will be apparent.

What is claimed is:

1. A sprinkler comprising a housing including an inlet connectable to a source of pressurized water, a first water distribution tube having a plurality of nozzles spaced along its length, a second, parallel water distribution tube having a plurality of nozzles spaced along its length, and an oscillating drive for cyclically oscillating said two chambers about a horizontal axis;

said plurality of nozzles of said first water distribution tube being oriented at different angles with respect to said horizontal axis than said plurality of nozzles of said second water distribution tube;

said sprinkler further including water-steering means for selectably steering the inletted water first to said first water distribution tube for a first period of the oscillating cycle of the sprinkler in order to produce a given spray pattern determined by the angles of the nozzles of said first water distribution tube, and then to said second water distribution tube, for a second period, different from said first period, in order to produce a different spray pattern determined by the angles of said nozzles of said second water distribution tube, said oscillating drive comprising an impeller rotated by the water flowing through the inlet, a shaft rotated by said impeller, and a crank rotated by said shaft and coupled to said water distributor tubes to oscillate them during the rotation of said shaft;

whereby all said nozzles are supplied with water for only their respective periods of the drive cycle and may therefore have a larger diameter for a given water pressure thereby increasing the sprinkler range and decreasing wind and evaporation losses.

2. The sprinkler according to claim 1, wherein both pluralities of spray nozzles are oriented at angles which increase from the outer ends of their respective water distributor tubes to their centers, the angles of one plurality of spray nozzles being staggered with respect to those of the other plurality of spray nozzles.

3. The sprinkler according to claim 1, wherein both of said water distributor tubes are in side-by-side relationship and are coupled by a common coupling member to said oscillating drive.

4. The sprinkler according to claim 1, wherein said shaft further drives said water steering means for selectively steering the water from said water inlet to different ones of said water distributor tubes during different cycles of oscillation of the sprinkler.

5. The sprinkler according to claim 4, wherein said water steering means comprises a valve driven by said oscillating drive to connect said water inlet to each of said water distributor tubes during alternate cycles of the sprinkler.

6. The sprinkler according to claim 5, wherein said valve comprises a pivotably mounted valve member movable with a snap-action by an over-center spring to connect one water distributor tube to the water inlet and to disconnect therefrom the other water distributor tube during one cycle of the sprinkler, and to disconnect the one water distributor tube from the water inlet and to connect thereto the other water distributor tube during the next cycle of the sprinkler.

7. A sprinkler according to claim 6, wherein one end of said over-center spring is connected to said pivotably mounted valve member, and the other end is connected to a pivotably mounted cam member, which cam member is oscillated to one side of the spring axis during one cycle of the sprinkler, and to the other side during the next cycle of the sprinkler.

8. The sprinkler according to claim 7, wherein said cam menber is oscillated by a pair of rotatable wheels both driven by said shaft, each of said wheels carrying pins engageable with said cam member to pivot said cam member.

9. The sprinkler according to claim 1, wherein each of said water distributor tubes is connected to said steering means via a flexible hose permitting the oscillation of the respective water distributor tubes.

* * * * *